United States Patent [19]

Kouno

[11] 4,330,607

[45] May 18, 1982

[54] METHOD FOR FORMING AN ELECTROSTATIC LATENT IMAGE

[75] Inventor: Akiyoshi Kouno, Tokyo, Japan

[73] Assignee: Nippon Electric Co., Ltd., Tokyo, Japan

[21] Appl. No.: 71,342

[22] Filed: Aug. 28, 1979

[30] Foreign Application Priority Data

Sep. 1, 1978 [JP] Japan ..... 53/107785

[51] Int. Cl.[3] ..... G03G 13/04

[52] U.S. Cl. ..... 430/48; 355/3 TE; 355/77

[58] Field of Search ..... 355/3 R, 3 TE, 77, 132; 430/48

[56] References Cited

U.S. PATENT DOCUMENTS

| | | | |
|---|---|---|---|
| 3,057,719 | 10/1962 | Byrne et al. | 430/48 |
| 3,322,539 | 5/1967 | Redington | 430/48 |
| 3,502,408 | 3/1970 | Brodie | 355/16 |
| 3,583,868 | 6/1971 | Noble et al. | 430/48 X |
| 3,619,054 | 11/1971 | Goffe | 355/3 R X |
| 3,963,488 | 6/1976 | Brushenko | 430/48 X |
| 3,989,519 | 11/1976 | Szymber | 430/48 |
| 4,023,895 | 5/1977 | O'Brien et al. | 430/48 X |

*Primary Examiner*—Fred L. Braun

*Attorney, Agent, or Firm*—Sughrue, Mion, Zinn, Macpeak & Seas

[57] ABSTRACT

A method for forming an electrostatic latent image usable to produce images free from fog and "gooseflesh" non-uniformity wherein an electrostatic recording medium placed between two electrodes and a photoconductive layer is illuminated in a first step while a voltage less than the minimum threshold recording voltage is applied across the electrodes and then exposed in a second step to an optical image while a voltage higher than the minimum threshold recording voltage is applied across the electrodes.

15 Claims, 8 Drawing Figures

METHOD FOR FORMING AN ELECTROSTATIC LATENT IMAGE

BACKGROUND OF THE INVENTION

The present invention relates to a method for forming an electrostatic latent image, and more particularly, to an improved method for forming an electrostatic latent image in electrophotography which can provide a high quality recording having excellent uniformity in the case of a recording containing a half-tone area.

Heretofore, an electrophotographic process has been known, in while an electrostatic recording medium such as an electrostatic recording paper sheet or a film of dielectric is urged against a photoconductive layer disposed on an electrode by means of a back surface electrode, the photoconductive layer is irradiated with and exposed to an optical image and also a voltage having a predetermined polarity is applied to said electrostatic recording medium, whereby an electrostatic latent image is formed on the electrostatic recording medium. Such a process is disclosed, for example, in U.S. Pat. No. 3,502,408. Generally, this type of electrophotographic process produces a reversed image after development with respect to the irradiated optical image. That is, an area corresponding to a bright area in the optical image is dark in the developed image, whereas another area corresponding to a dark area in the optical image is a bright area in the developed image. Although this electrophotographic process is suitable for the purpose of recording an image containing a half-tone area due to the fact that an electric charge corresponding in amount to the amount of exposure is transferred onto an electrostatic recording paper web, it has the short coming that gooseflesh nonuniformity occurs in half-tone area and the quality of picture is poor. Also the term "gooseflesh" non-uniformity as used herein means at those areas of a recording paper sheet which must properly have a uniform tone at a white or intermediate level, do not have a uniform tone, but a spotted pattern on the order of millimeters throughout the areas at a denser tone than the proper tone of those areas. Since this nonuniformity is marked when an electrostatic recording paper web isused as an electrostatic recording medium and it varies depending upon the varieties of photoconductive layers, the kinds of electrostatic recording paper webs, and the like, it is believed that the nonuniformity is caused by micro-fine fluctuations in the width of the gap clearance formed between the photoconductive layer and the electrostatic recording paper web due to micro-fine unevenness of of paper web and by the surface condition and thickness of the photoconductive layer and dielectric layer of the electrostatic recording paper web.

However, the mechanism of generation of the nonuniformity has not been known in detail because the width of the gap clearance as well as the electrostatic capacity of the photoconductive layer and the electrostatic recording paper web could not be measured precisely under practical recording conditions and hence it has been very difficult to improve the gooseflesh nonuniformity.

As one approach for reducing the nonuniformity of recording an electrophotographic process was proposed that would utilize an operating region having the maximum amount of electric charge transfer. More particularly a novel electrophotographic process was proposed in which a voltage that is 10 V or more higher in absolute value than the threshold value necessary for depositing electric charge on an area of a recording paper web corresponding to the minimum exposure area, is applied across a photoconductive layer to make electric charge deposit even onto a dark area of an optical image where originally electric charge would not deposit, thus forming a so-called excessive electrostatic latent image having many fog areas, upon development the latent image is developed while applying an inverse bias voltage for suppressing deposition of a charged toner, whereby the nonuniformity of recording is reduced. However, even with such a proposed process, the nonuniformity was eliminated perfectly, and hence it has been impossible to obtain a high quality recording having good uniformity such as the conventional optical photograph.

SUMMARY OF THE INVENTION

It is one object of the present invention to provide a method for forming an electrostatic latent image, which obviates the above-mentioned shortcomings and enables electrophotographic recording that is quite free from a fog and has high quality with good uniformity upon recording of a picture containing a half-tone area.

Another object of the present invention is to provide a method for forming an electrostatic latent image which does not produce gooseflesh nonuniformity nor fog at all even at a low optical density area, that is, even at areas where the transferred electric charge is small.

According to one feature of the present invention, there is provided a method for forming an electrostatic latent image, which comprises the steps of (1) placing an electrostatic recording medium between a photoconductive layer provided on one electrode (2) and the other electrode, preliminarily irradiating the photoconductive layer with a first optical image which gives an exposure of a predetermined value except for areas where generation of a fog is undesired while applying across the two electrodes a first voltage that is sufficiently low that no substantial fog is generated in response to an exposure equal to the predetermined value, and (3) irradiating the photoconductive layer with a record optical image to be recorded while applying across the two electrodes a second voltage higher than the first voltage, whereby an electrostatic latent image corresponding to the second optical image that is free from gooseflesh non-uniformity can be formed.

Upon practicing the above-featured invention, it is most suitable in view of simplicity of construction of apparatus to use identical optical images for the first and second optical images. However, from the view point of eliminating non-uniformity of recording, a first optical image of the so-called binarized form may be used, in which only the area that is not irradiated with light in the optical image to be recorded (the second optical image) is not irradiated with light and the other area is irradiated with uniform light. Otherwise, a first optical image that is formed by cutting out an area having a low illumination intensity in the optical image to be recorded, may be used. Provided that the relative illumination intensity distribution is identical between the first and second optical images, the first optical image may have either a higher or lower illumination intensity than the second optical image.

In the above-featured invention, the first voltage is a voltage lower than a recording threshold voltage that is normally 300~400 V, and preferably it is in the range between 100 V and a minimum recording threshold voltage in absolute value. The time period of the first step in which the photoconductive layer is irradiated with the first optical image while having applied the first voltage is, in practice, equal to 0.1 to 5 seconds. The second voltage as used in the present invention is a voltage higher than the recording threshold voltage, and preferably it is a voltage within the range above a minimum threshold voltage and a recording threshold voltage at any exposure and below and about 700 V in absolute value. The time period of the second step in which the photocondcutive layer is irradiated with the second optical image while having applied the second voltage is, in practice, equal to 0.5 to 5 seconds.

By employing the above-described method for forming an electrostatic latent image, recording of a picture containing a half-tone area, that is, recording of a picture which includes not only areas at white and black levels but also areas at a plurality of intermediate levels between the white and black levels, can be achieved without being associated with "gooseflesh" non-uniformity and fog. The term "fog" as used herein means that those areas of a recording paper sheet which must be properly white (the basic white color of the recording paper sheet) after development become wholly and uniformly grey. For instance, it means the case where upon copying characters written on a white paper sheet with a Xerox machine or the like, the basic color of the Xerox-copied paper sheet is blackened as compared sheet before copying.

As used herein, the recording threshold voltage means the lowest voltage by which a surface potential (a latent image potential) is formed on the recording paper web that is sufficient to effect recording by development of the latent image potential with a toner. The recording threshold voltage varies with amount of exposure. This voltage takes a high level such as 450 V in absolute value at low exposure condition. However, when the exposure increases to 2 lux seconds, or more, the recording threshold decreases and converges to a fixed value or a minimum recording threshold value such as 350 V in absolute value as shown in FIG. 8. In the high exposure condition, the recording threshold value is defined by the material, thickness and surface unevenness of the electrostatic recording medium. Therefore, the minimum recording threshold voltage depends on the electrostatic recording medium per se, namely on the electrostatic recording paper web per se.

DETAILED DESCRIPTION OF PREFERRED EMBODIMENTS

Figure 1:
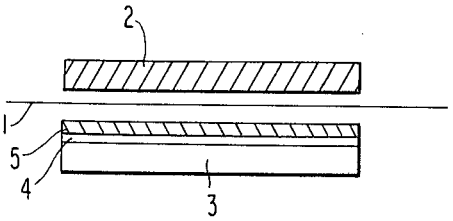
FIG. 1 is a schematic view showing a basic arrangement of various elementary members for explaining an electrophotographic process to which the present invention is applied.

A basic arrangement of various elementary members for practicing an electrophotographic process to which the present invention is applied is illustrated in FIG. 1, in which reference numeral 1 designates an electrostatic recording paper sheet serving as an electrostatic recording medium, numeral 2 designates a back elecrode which serves as an electrode for a back conductive layer of the electrostatic recording paper sheet 1, numeral 3 is a glass base plate on which a transparent electrode 4 is deposited, and numeral 5 is a photoconductive layer 5 on the transparent electrode 5. This layer is irradiated with an optical image to be recorded from the side of the glass base plate 3. The illustrated arrangement is a basic one and various modifications can be made thereto. For instance, it is possible to use a transparent dielectric film as an electrostatic recording medium and to form the back electrode as a transparent electrode so that the photoconductive layer 5 may be irradiated with an optical image through the back electrode. In this modified case, the base plate for the photoconductive layer 5 and the electrode 4 thereon could be opaque. Furthermore, the photoconductive layer need not be formed on a plane base plate but could be formed on a cylindrical drum. Also, since a normal electrostatic recording medium includes a conductive layer, it is possible to apply a desired voltage to the electrostatic recording medium by means of an electrode which only partly makes contact with the electrostatic recording medium. Thus, while the present invention can be practiced in various modified forms as described above, in the followings description will be made with respect to the most general arrangement as illustrated in FIG. 1.

Figure 2:
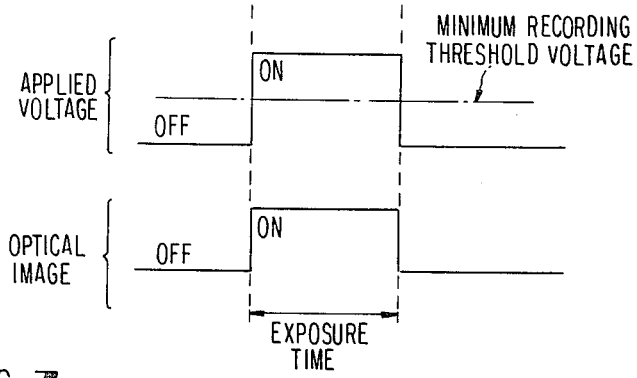
FIG. 2 (PRIOR ART)
FIG. 2 is a timing chart in the process for forming an electrostatic latent image in the prior art.

Heretofore, in the process for forming an electrostatic latent image in electrophotography employing the above-described arrangement, it was common practice to use a one-step process for forming a latent image. In this procedure, after the back electrode 2 has been moved so as to urge the electrostatic recording paper sheet 1 up to a position where a dielectric layer of the electrostatic recording paper sheet 1 makes contact with the photoconductive layer 5, the photoconductive layer 5 (of a sintered CdS layer of 45$\mu$ in thickness) is irradiated with an optical image while applying a voltage equal to or higher than the voltage which can provide a desired latent image potential between the back electrode 2 and the transparent electrode 4, as shown by the timing chart in FIG. 2. Since the only necessary condition in this process for forming an electrostatic latent image is to provide an exposure time period in which the irradiation with the optical image and the application of the voltage overlap with each other, the prior art process for forming an electrostatic latent image had the advantage of simplicity. However, as hereinbefore explained the recorded picture obtained through such a method was a very unsightly image in which gooseflesh non-uniformity arose at the surface area of the photoconductive layer having a low surface potential with respect to the electrode on the backside of the electrostatic recording paper sheet, that is, those areas corresponding to a low potential difference between the front and back surface of the photoconductive layer, on the order of 0 to 60 V would display the "gooseflesh nonuniformity."

Figure 3:
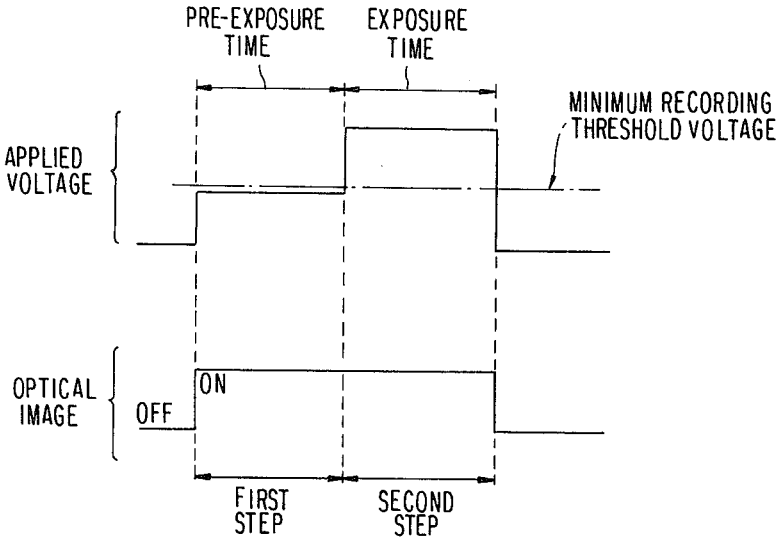
FIG. 3 is a timing chart in the process for forming an electrostatic latent image according to the present invention.

By contrast, the method for forming an electrostatic latent image according to the present invention comprises a pre-exposure period forming a first step and an exposure period forming a second step as illustrated in the timing chart in FIG. 3. More particularly, in the first step, the photoconductive layer is irradiated with a first optical image while a relatively low first voltage, that is, a first voltage lower than the minimum recording threshold voltage, is being applied between the back electrode and the transparent electrode.

With regard to the first optical image, it is necessary that for areas where the recording density is relatively high in the final record and "gooseflesh" non-uniformity raises a problem the first optical image give a sufficient exposure, whereas for areas where the recording density is relatively low and a fog raises a problem the first optical image gives such a small exposure that a fog does not arise. Accordingly, it is suitable to make the first optical image identical to the optical image to be recorded the second optical image, or to use an optical image that is equal in geometric pattern but different in illumination intensity distribution to and from the optical image to be recorded. In addition, the average value of the first voltage must be selected at such a value that for an area where a fog otherwise would raise a problem, fog will not be significant in the final record. While the extent of the fog is different depending on the method for development, in order that no substantial recording may be effected, it is necessary that the surface potential on the recording medium should be normally about 10 V or less in absolute value. Moreover, it is desirable that this first voltage is equal to or lower than the minimum recording threshold voltage. Within the above-described voltage range, as the first voltage comes closer to the minimum threshold voltage, the non-uniformity is reduced. However, if the first voltage exceeds the minimum recording threshold value, then the first step of operation according to the present invention becomes similar to the heretofore known process for forming an electrostatic latent image consisting of a single step, and thus an electrostatic latent image having much non-uniformity is formed in the first step of operation. Although the above-mentioned non-uniformity generated in the first step can be hidden to a certain extent in the subsequent second step for electric charge transfer, it is more desirable that the non-uniformity not be generated. In practice, the minimum fixed recording threshold voltage is about 350 V in the case where a recording paper sheet having little non-uniformity for recording of a half-tone area, such as, for example, model K-31T recording paper sheet manufactured by Kanzaki Paper Mfg. Co. in Japan is employed as an electrostatic recording paper sheet; and when the applied voltage in the above-described first step was selected at 300 V or higher but below 350 V, a record that was free from to completely suppress the "gooseflesh" non-uniformity "gooseflesh" non-uniformity was obtained. It was only necessary that exposure in the first step be maintained at a level over a certain value, by carrying out the irradiation for a long period of time when the illumination intensity of the first optical image at the area where the "gooseflesh" non-uniformity otherwise raises a problem was low, or for a short period, when it was high. In the case where the aforementioned CdS photoconductive layer and the electrostatic recording paper sheet of model K-31T manufactured by Kanzaki Paper Mfg. Co. were employed, at an exposure which amounts to 2.5 lux×seconds at the highest illumination area of the optical image on the photoconductive layer, the "gooseflesh" non-uniformity disappeared in every optical density area.

While the pre-exposure period in the first step could be prolonged if the illumination intensity of the optical image is low, in practice it is limited due to fog portion of the optical image caused by a dark resistance of the photoconductive layer, and hence for the purpose of obtaining a record that is free from a fog, a pre-exposure period of 5 seconds or less is appropriate, and practically it is 0.1 seconds or longer.

From the above it is seen that the preferred condition for the first step is that while applying a first voltage lower than the minimum fixed recording threshold voltage, irradiation with an optical image is effected by an amount equal to or larger than a predetermined integrated illumination intensity.

Subsequently, in the second step the preferred condition is that the applied voltage be raised to a second voltage which exceeds, at least in its peak value, the minimum threshold voltage and the recording threshold voltage at any exposure, and the photoconductive layer be irradiated with a second optical image to be recorded. This second step is similar to the process for forming an electrostatic latent image consisting of a single step in the prior art, and in the second step while the applied voltage is raised higher than a voltage at which a desired latent image voltage is obtained, the photoconductive layer is irradiated with optical image to be recorded for a predetermined period of time.

In the case of the combination of the above-referred to photoconductive layer and electrostatic recording paper sheet, when the applied voltage was 500 V and the maximum illumination intensity was 2.5 luxes, in the second step a maximum surface potential of the latent image of -100 V was obtained in response to an exposure for 0.5 seconds. While the polarity of the voltage applied to the back surface of the photoconductive layer was assumed to be negative in the above-described example, in some cases preferably the polarity of the applied voltage should be selected to be positive depending upon the material of the photoconductive layer.

In the embodiment shown in FIG. 3, the first and second voltages maintained at constant levels, respectively, during the period of each step. However, each voltage may take a slope form which increases or decreases gradually, or may have pulse or rippled form, so long as the first voltage is under the minimum recording threshold voltage and the second voltage exceeds, at least in its peak value, the minimum recording threshold voltage and the recording voltage at any exposure.

Although it has been confirmed through a great many experiments that a record having no "gooseflesh" non-uniformity at all and also having no fog can be obtained by forming an electrostatic latent image through the above-described two-step process, the mechanism of operation of the process has not been understood exactly.

However, as a result of the great many experiments it may be surmised, for instance, that in response to the voltage application and irradiation with an optical image in the first step, the voltage divided and applied across the photoconductive layer is discharged at areas corresponding to the optical image and thereby the voltage applied across the gap clearance between the photoconductive layer and the dielectric layer of the electrostatic recording paper sheet reaches a voltage close to a discharge voltage; and hence upon forming an electrostatic latent image in the subsequent step, non-uniformity will not arise, or when the applied voltage is raised to a level higher than the recording threshold voltage (according to the condition for forming a latent image in the second step) the voltage divided and applied across the photoconductive layer becomes small, and hence non-uniformity will not arise.

It has been also confirmed that in view of the above-mentioned operation mechanism, even if the light to be irradiated in the first step is not an optical image but is uniform light, a similar improvement in "gooseflesh" non-uniformity is achieved. However, such a process has the shortcoming that since the voltage across the gap clearance at the area corresponding to the dark area of the optical image to be irradiated in the second step has already reached a level just under a discharge voltage, when the applied voltage is raised higher than the recording threshold voltage in the second step, the voltage across the gap space becomes higher than the discharge voltage due to a voltage divided by the electrostatic capacity of the gap clearance, and therefore, electric charge transfer occurs regardless of the irradiation with the optical image in the second step and thus a fog connot be avoided.

On the other hand, in the case where the light irradiated in the first step is light forming an optical image, the dark area in the optical image to be irradiated in the second step is also a dark area upon irradiation of an optical image in the first step, so that the voltage divided by and applied across this area of the photoconductive layer is not discharged in the first step and the gap clearance voltage at this area can be maintained at a voltage that is sufficiently lower than the discharge voltage; and therefore there is the advantage that even if the applied voltage is raised to a level higher than the recording threshold voltage in the second step, electric charge transfer does not occur and thus no fog is generated.

Figure 4:
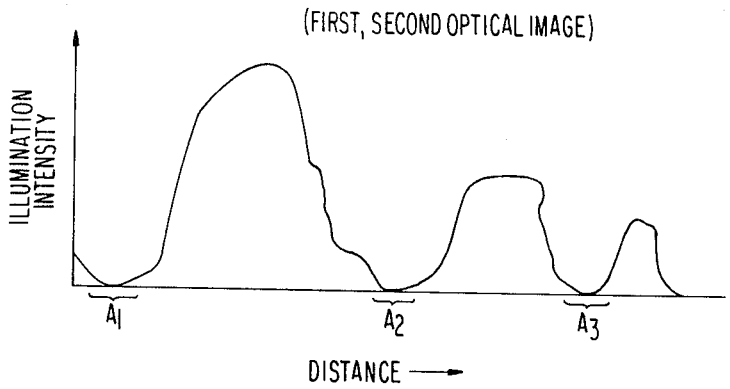
FIG. 4 is a diagram showing an illumination intensity distribution of an optical image in one preferred embodiment of the present invention, FIG. 5 and 6, respectively, are diagrams showing an illumination intensity distribution of a first optical image in alternative preferred embodiments of the present invention.

In the above-described embodiment of the present invention, the first optical image and the second optical image were the same. For instance, assuming that the illumination intensity distribution along one direction of the optical image is as shown in FIG. 4, then the areas where a fog raises a problem are the areas $A_1$, $A_2$ and $A_3$ where electric charge transfer is not effected and thus the recording paper sheet is to be white after development. If the same optical image is used both as the first optical image and as the second optical image, then since these areas $A_1$, $A_2$ and $A_3$ are not irradiated with light in the first step, the operation is identical to that in the process for forming an electrostatic latent image in a single step in the prior art, and therefore, no fog would arise at these areas $A_1$, $A_2$ and $A_3$ in the formed electrostatic latent image. From the above-described facts it is seen that normally it is most appropriate in view of simplicity of construction of the apparatus to use the same optical impage for the first and second optical.

Figure 5:
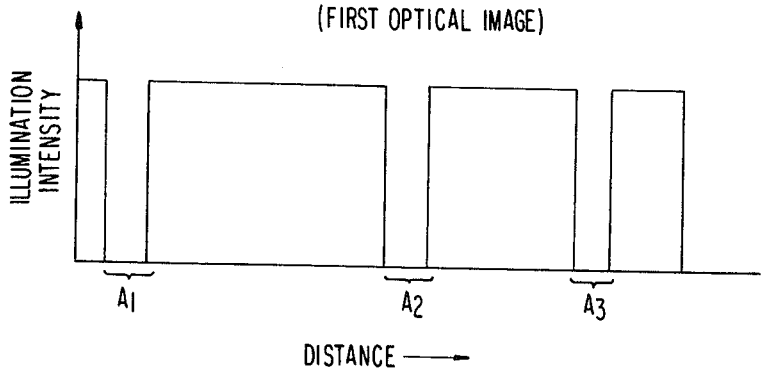

On the other hand, the first optical image could be an optical image having a binarized illumination intensity distribution as shown in FIG. 5 which takes a lower level in the proximity of the areas $A_1$, $A_2$ and $A_3$ in FIG. 4 and takes a higher level in the remaining area.

Figure 6:
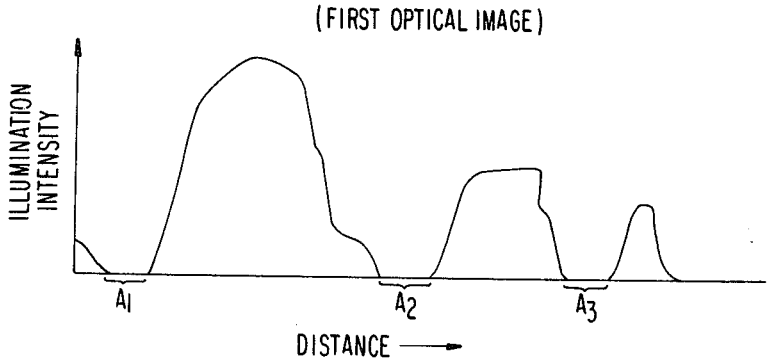
Figure 8:
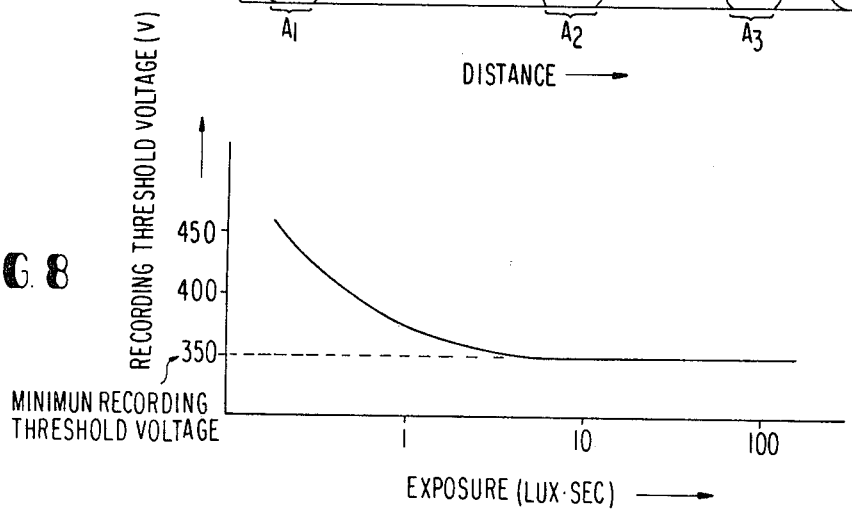
FIG. 8 is a graph showing a typical relationship between recording threshold voltage and exposure.

Alternatively, the first optical image could be an optical image as shown in FIG. 6 which has the areas having a low illumination intensity in the proximity of the areas $A_1$, $A_2$ and $A_3$ in FIG. 4 cut out.

Figure 7:
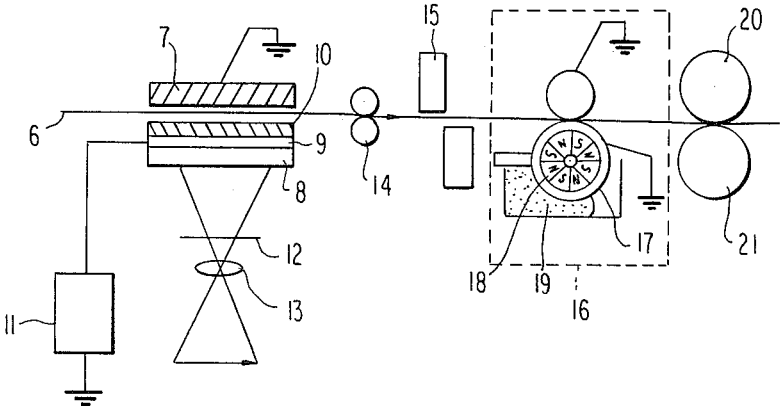
FIG. 7 is a schematic view showing one example of an electrophotographic apparatus embodying the present invention.

FIG. 7 is a schematic view showing one example of an electrophotographic apparatus embodying the process for forming an electrostatic latent image according to the present invention. In FIG. 7 reference numeral 6 designates an insulative recording medium consisting of the above-referred model K-31T electrostatic recording paper web manufactured by Kanzaki Paper Mfg. Co.; numeral 7 designates a grounded back electrode consisting of a conductive sponge member for making contact with a conductive layer on the back surface of the electrostatic recording paper web 6 and also for bringing the electrostatic recording paper web 6 into tight contact with a photoconductive layer 10; numeral 8 designates a Pyrex glass base plate, on which a transparent electrode 9 made of $SnO_2$ is formed, and on the transparent electrode 9 is formed a photoconductive layer 10 of 45 $\mu$ in thickness consisting of a sintered layer of CdS. In addition, to the transparent electrode 9 is connected a power supply circuit 11.

Upon forming an electrostatic latent image in the thus constructed electrophotographic apparatus, at first the back electrode 7 is moved to bring the dielectric layer of the electrostatic recording paper web 6 into tight contact with the photoconductive layer 10. Then, since the dielectric layer and the photoconductive layer both essentially have a surface unevenness of the order of $5\sim10\mu$, a gap clearance of $5\sim10\mu$in average width is formed therebetween.

Subsequently, under the aforementioned condition, an electrostatic latent image is formed through the following two steps. In the first step, a voltage of $-300$V for the maximum exposure (when the above-referred sintered CdS layer of $45\mu$in thickness and K-31T type electrostatic recording paper web of Kanzaki Paper Mfg. Co. are employed), is applied from the power supply circuit 11 to the transparent electrode 9, and at the same time a shutter 12 is opened, so that an optical image having the maximum illumination intensity of 2.5 luxes may be focused on the photoconductive layer 10 by means of a lens 13. Under the aforementioned condition, pre-exposure is effected for one second.

In the next second step, the voltage of $-300$V applied in the first step is raised up to $-500$V and the shutter 12 is continuously held open to irradiate the photoconductive layer 10 with the optical image.

After an exposure for 0.4 seconds, the applied voltage is switched, and the back electrode 7 is moved to separate the electrostatic recording paper web 6 from the photoconductive layer 10. At this moment, a latent image having a highest potential of about $-70$ V is obtained on the dielectric layer of the electrostatic recording paper web 6. Thereafter, the electrostatic recording paper web 6 having an electrostatic latent image formed thereon is fed to a developer section 16 by means of paper feed rollers 14, and when a predetermined length of web has been fed, the web is cut by means of a cutter 15.

The developer section 16 forms the so-called carrierless toner developing unit, in which an 8-pole magnet roll 18 is contained within a grounded nonmagnetic sleeve 17, and development is effected by conveying carrierless toner 19 to the top of the sleeve 17 while rotating this magnet roll 18, and bringing it into contact with the electrostatic recording paper sheet. Then, the electrostatic recording paper sheet developed in the developer section 16 is pressure-fixed by means of a pair of pressure rollers 20 and 21, and thereby a highly qualified record containing a half-tone area which has no "gooseflesh" non-uniformity at all nor any fog, can be obtained.

It is to be noted that since the carrierless toner used in the above-described embodiment does not bear electric charge by itself, it is impossible to eliminate fog by applying an inverse bias upon development; hence in order to obtain a record that is free from fog it is essentially necessary to form a fogless latent image upon forming an electrostatic latent image, and therefore, the process for forming an electrostatic latent image according to the present invention is essential for use of the carrierless toner.

As described above, according to the present invention, one can obtain a high quality electrophotographic picture image containing a half-tone area which has no "gooseflesh" non-uniformity at all and which has no fog.

I claim:

1. A method for forming an electrostatic latent image on an electrostatic recording medium placed between a photoconductive layer disposed on a first electrode and a second electrode, said electrostatic recording medium having a minimum recording threshold voltage with respect to an amount of exposure, said method comprising the step of (1) placing said electrostatic recording medium between said photoconductive layer and said second electrode, (2) thereafter projecting a first optical image onto said photoconductive layer while applying a first voltage lower than said minimum recording threshold voltage and higher than 100 V between said first and second electrodes such that no electrostatic latent image is formed on said electrostatic recording medium, and (3) immediately thereafter projecting a second optical image onto said photoconductive layer while applying a second voltage higher at least in its peak value than the recording threshold voltage at any exposure between said first and second electrodes so that said second optical image is formed on said electrostatic recording medium as said electrostatic latent image.

2. A method for forming an electrostatic latent image as claimed in claim 1, in which at least one of said first and second electrodes is a transparent electrode, and the projections of said first and second optical images are effected through said transparent electrode.

3. A method for forming an electrostatic latent image as claimed in claim 1, in which said first and second optical images are identical images.

4. A method for forming an electrostatic latent image as claimed in claim 1, in which said first and second optical images have respective illumination intensity distributions which are different in magnitude but similar to each other in geometric pattern.

5. A method for forming an electrostatic latent image on an electrostatic recording medium comprising the steps of placing electrostatic recording medium having a minimum recording threshold voltage between a photoconductive layer disposed on a first electrode and a second electrode, therafter projecting a first optical image onto said photoconductive layer and at the same time applying a first voltage between said first and second electrodes, said first voltage being between 100 V and said minimum recording threshold voltage in absolute value so that no electrostatic latent image is formed on said electrostatic recording medium, and projecting a second optical image to be recording medium, and projecting a second optical image to be recorded onto said photoconductive layer and applying a second voltage between said first and second electrodes, said second voltage having such a value that an electrostatic latent image corresponding to said second optical image is formed on the recording surface of said electrostatic recording medium.

6. A method for forming an electrostatic latent image as claimed in claim 5, in which said first voltage is selected such that the surface potential in absolute value of said electrostatic recording medium may become about 10 V or less in absolute value.

7. A method for forming an electrostatic latent image as claimed in claim 5, in which said first and second optical images are identical images.

8. A method for forming an electrostatic latent image of an optical image comprising the steps of:

(1) placing an electrostatic recording medium between a first electrode having thereon a photoconductive layer and a second electrode, wherein said electrostatic recording medium has a minimum recording threshold voltage with respect to amount of expsoure;

(2) illuminating a pre-optical image onto said photoconductive layer with light while applying a first voltage lower than said minimum recording threshold voltage and higher than 100 V in absolute value between said electrodes so that a latent image of said pre-optical image which has sufficient surface potential to effect recording by developing with a toner is not formed on said electrostatic recording medium; and then (3) projecting said optical image onto said photoconductive layer while applying a second voltage higher than the minimum recording threshold voltage between the electrodes.

9. The method of claim 8 wherein in step 2 the said pre-illumination consists of projecting an optical image onto said photoconductive layer.

10. The method of claim 9 wherein the optical image used in step 2 has an illumination intensity distribution which is similar to that of the optical image used in step 3 geometric pattern.

11. The method of claim 10 wherein the optical images used in steps 2 and 3 are identical.

12. The method of claim 10 wherein the optical image used in step 2 has an illumination intensity distribution which is a binarized representation of the illumination intensity distribution of the optical image used in step 3.

13. The method of claim 8 wherein the time of projection of the optical image in step 3 is between 0.1 and 5 seconds.

14. The method of claim 8 wherein the illumination time in step 2 is between 0.1 and 5 seconds.

15. An electrophotographic method for forming an image comprising the steps of:

(1) placing an electrostatic recording medium between a first electrode having thereon a photoconductive layer and a second electrode, wherein said electrostatic recording medium has a minimum recording threshold voltage with respect to amount of exposure;

(2) illuminating a pre-optical image onto said photoconductive layer with light while applying a first voltage lower than said minimum recording threshold voltage and higher than 100 V in absolute value between said electrodes so that a latent image of said pre-optical image which has sufficient surface potential to effect recording by developing with a toner is not formed on said electrostatic recording medium; and then (3) projecting said optical image onto said photoconductive layer while applying a second voltage higher than the minimum recording threshold voltage between the electrodes to form an electrostatic latent image;

(4) developing the electrostatic latent image using a carrierless toner.

* * * * *

UNITED STATES PATENT AND TRADEMARK OFFICE

CERTIFICATE OF CORRECTION

PATENT NO. : 4,330,607

DATED : May 18, 1982 PAGE 1 OF 2

INVENTOR(S) : Akiyoshi KOUNO

It is certified that error appears in the above—identified patent and that said Letters Patent is hereby corrected as shown below:

IN THE SPECIFICATION:

Column 1, line 13, after "in", insert -- which, -- line 44, change "isused" to -- is used -- line 51, after "of" (first occurrence), insert -- the surface -- and after "of" (second occurrence), insert -- the --

Column 3, line 10, after "below", delete "and"

line 41, after "threshold", insert -- voltage --

Column 5, line 59, delete "to completely suppress the"

line 60, delete " "gooseflesh" non-uniformity"

line 61, after "obtained", insert -- to completely suppress the "gooseflesh" non-uniformity --, delete the period, and change "It" to -- it --

Column 6, line 11, after "fog", insert -- in a dark -- line 48, after "voltages", insert -- are -- line 55, after "recording", insert -- threshold --

Column 7, line 28, change "connot" to -- cannot -- line 39, delete "and"

line 62, change "impage" to -- image --

UNITED STATES PATENT AND TRADEMARK OFFICE

CERTIFICATE OF CORRECTION

PATENT NO. : 4,330,607

DATED : May 18, 1982

INVENTOR(S) : Akiyoshi KOUNO

It is certified that error appears in the above—identified patent and that said Letters Patent is hereby corrected as shown below:

Column 8, line 31, change "10μin" to -- 10μ in --
line 37, change "45μin" to -- 45μ in --

IN THE CLAIMS:

Column 9, line 29, change "step" to -- steps --
line 62, change "therafter" to -- thereafter --

Column 10, line 24, change "expsoure" to -- exposure --

Signed and Sealed this

*Third* Day of *August 1982*

[SEAL]

*Attest:*

GERALD J. MOSSINGHOFF

*Attesting Officer*

*Commissioner of Patents and Trademarks*